US011502398B2

(12) United States Patent
Gomez

(10) Patent No.: US 11,502,398 B2
(45) Date of Patent: Nov. 15, 2022

(54) COMPOUND CURVATURE CONFORMAL ANTENNA

(71) Applicant: PCTEL, INC., Bloomingdale, IL (US)

(72) Inventor: Francisco X. Gomez, West Chicago, IL (US)

(73) Assignee: PCTEL, INC., Bloomingdale, IL (US)

( * ) Notice: Subject to any disclaimer, the term of this patent is extended or adjusted under 35 U.S.C. 154(b) by 190 days.

(21) Appl. No.: 16/921,671

(22) Filed: Jul. 6, 2020

(65) Prior Publication Data

US 2021/0098867 A1 Apr. 1, 2021

Related U.S. Application Data

(60) Provisional application No. 62/908,577, filed on Sep. 30, 2019.

(51) Int. Cl.
*H01Q 1/42* (2006.01)
*H01Q 1/12* (2006.01)

(52) U.S. Cl.
CPC ..... *H01Q 1/42* (2013.01); *H01Q 1/12* (2013.01)

(58) Field of Classification Search
CPC ..... H01Q 1/12; H01Q 1/1207; H01Q 1/1214; H01Q 1/27; H01Q 1/32; H01Q 1/3275; H01Q 1/40; H01Q 1/405; H01Q 1/42
See application file for complete search history.

(56) References Cited

U.S. PATENT DOCUMENTS 6,023,245 A * 2/2000 Gomez ..... H01Q 5/40 343/700 MS
6,054,961 A 4/2000 Gong et al.
6,773,018 B2 * 8/2004 Gomez ..... H01Q 1/02 277/630
7,106,272 B2 * 9/2006 Noro ..... H01Q 1/3275 343/878
2003/0068198 A1 * 4/2003 Kozlovski ..... H01Q 1/3275 403/372
2003/0094770 A1 * 5/2003 Gomez ..... F16J 15/025 277/626
2003/0197649 A1 * 10/2003 Kozlovski ..... H01Q 1/1214 343/711
2008/0100521 A1 * 5/2008 Herbert ..... H01Q 1/1214 343/713
2008/0111752 A1 * 5/2008 Lindackers ..... H01Q 5/371 343/872

(Continued)

OTHER PUBLICATIONS

Extended European search report from corresponding EP patent application 20188766.8, dated Jan. 26, 2021.

*Primary Examiner* — Jason Crawford
(74) *Attorney, Agent, or Firm* — Husch Blackwell LLP

(57) ABSTRACT

A complex curvature conformal antenna system that can include an RF antenna element, a radome housing the RF antenna element, and a contour matching conformal gasket sealed to the radome such that, when the contour matching conformal gasket is installed on an installation surface having a complex compound curvature and features, the contour matching conformal gasket can be configured to conform to the complex compound curvature and features to seal the contour matching conformal gasket to the installation surface and protect the RF antenna element from external moisture, dust, or unwanted elements.

17 Claims, 6 Drawing Sheets

(56) References Cited

U.S. PATENT DOCUMENTS

| | | | | |
|---|---|---|---|---|
| 2008/0122708 | A1* | 5/2008 | Lindackers | H01Q 1/1214 343/713 |
| 2009/0066593 | A1* | 3/2009 | Jared | H01Q 1/1214 343/713 |
| 2010/0328179 | A1* | 12/2010 | Taki | H01Q 1/1207 343/841 |
| 2013/0229315 | A1* | 9/2013 | Duzdar | H01Q 9/0407 343/713 |
| 2014/0227027 | A1* | 8/2014 | Berger | H01Q 1/42 403/336 |
| 2014/0292593 | A1* | 10/2014 | Thiam | H01Q 9/32 343/893 |
| 2015/0318608 | A1 | 5/2015 | Tran et al. | |
| 2016/0064807 | A1* | 3/2016 | Reed | H01Q 21/28 343/749 |
| 2016/0104932 | A1* | 4/2016 | Aminzadeh | H01Q 5/40 343/872 |
| 2016/0268790 | A1* | 9/2016 | Panfil | F16J 15/14 |
| 2017/0317407 | A1* | 11/2017 | Yasin | H01Q 1/3275 |
| 2018/0109006 | A1* | 4/2018 | Ng | H01Q 1/405 |
| 2018/0351243 | A1* | 12/2018 | Lewis | H01Q 1/282 |
| 2021/0098867 | A1* | 4/2021 | Gomez | H01Q 1/42 |
| 2021/0119316 | A1* | 4/2021 | Borchani | H01Q 1/3275 |

* cited by examiner

COMPOUND CURVATURE CONFORMAL ANTENNA

CROSS REFERENCE TO RELATED APPLICATIONS

This application claims priority to U.S. application Ser. No. 62/908577 filed Sep. 30, 2019 and titled "COMPOUND CURVATURE CONFORMAL ANTENNA," U.S. application Ser. No. 62/908,577 is hereby fully incorporated by reference as if set forth fully herein.

FIELD

The present invention relates generally to antennas. More particularly, the present invention relates to a compound curvature conformal antenna.

BACKGROUND

U.S. Pat. No. 6,773,018 discloses a sealable antenna housing. However, problems arise when an antenna must be mounted onto a surface having a complex compound curvature and features. Accordingly, there is a continuing, ongoing need for an improved antenna.

DETAILED DESCRIPTION

Figure 1:
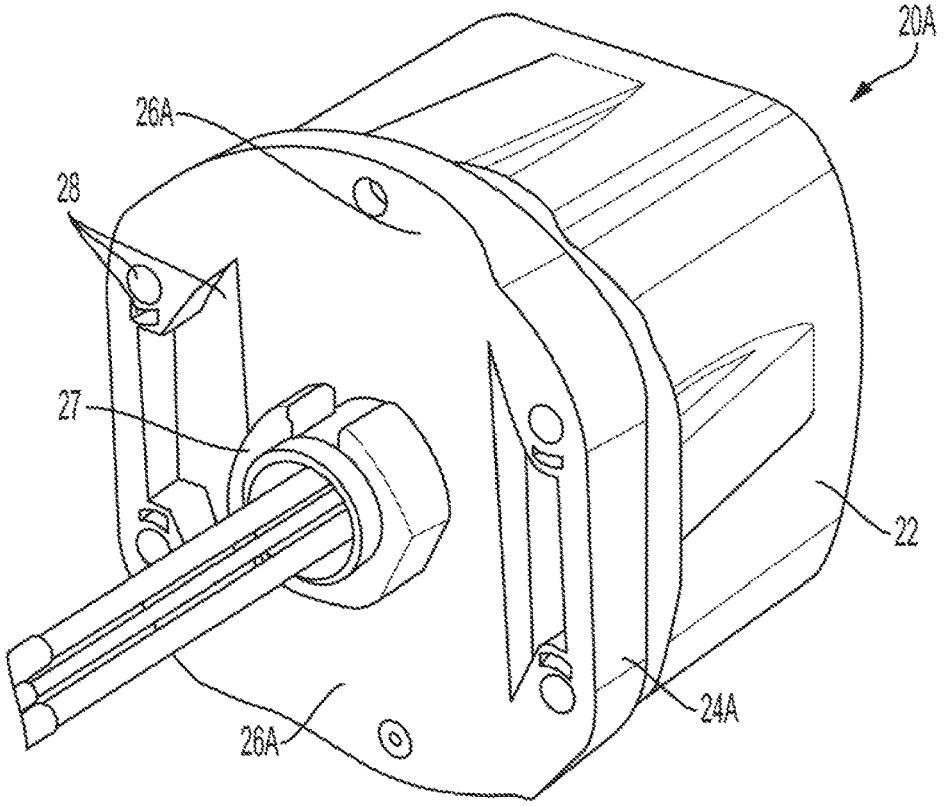
FIG. 1 is perspective view of an antenna system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include a complex curvature conformal antenna. For example, the complex curvature conformal antenna disclosed herein can include a contour matching conformal gasket with contour matching geometry for installation onto an installation surface having a complex compound curvature and features. In this regard, it is to be understood that such conformability can protect internal RF antenna elements and isolated spaces of the complex curvature conformal antenna from external moisture, dust, or unwanted elements. In particular, when installed, the contour matching conformal gasket can conform to a plurality of varying installation surface conditions and, in some embodiments, be used in connection with the sealable antenna housing disclosed in U.S. Pat. No. 6,773,018 to offer interchangeability to an antenna platform and create a platform design of multiband antennas that can be adapted to changing and/or multiple installation interfaces and complex compound curvature installation surfaces, including, but not limited to surfaces of mobile vehicles, aircraft's, marine vehicles, fixed and portable enclosures, and the like.

In accordance with disclosed embodiments, the contour matching conformal gasket can be fastened or anchored between a radome and abase of the complex curvature conformal antenna to protect the internal RF antenna elements and can include sealing interface features to match sealing geometries of the radome and the base. For example, in some embodiments, the contour matching conformal gasket can be over molded onto the base via insert molding, multi-shot injection molding, reaction injection molding (RIM), cast over molding, or lamination. Alternatively, in some embodiments, the contour matching conformal gasket can be assembled separately from the complex curvature conformal antenna and then subsequently coupled to the radome.

In some embodiments, the contour latching conformal gasket can include a flexible wiper edge or a contour matching wiper edge with a wiper geometry that can sweep along a prevailing perimeter edge geometry of the contour matching conformal gasket to allow and account for tolerance range variations of the complex compound curvature installation surfaces. In particular, in some embodiments, the flexible wiper edge or the contour matching wiper edge can be compressed during installation to produce a perimeter squeezing effect of the contour matching conformal gasket with respect to outer walls of the radome to enhance a primary seal between the radome and the contour matching conformal gasket.

FIG. 1 is a perspective view of an antenna system 20A in accordance with disclosed embodiments. As seen in FIG. 1, the antenna system 20A can include a radome 22 housing an RF antenna element 30 (see FIG. 2), a contour matching conformal gasket 24A, and a fastener 27 for coupling the antenna system 20A to an installation surface. For example, in some embodiments the fastener 27 can include a threaded nut that can (1) screw around an outside of a through channel for connecting RF cables to the RF antenna element 30 and (2) tighten against an underside of the installation surface to secure the antenna system 20A in place.

In some embodiments, the contour matching conformal gasket 24A can include (1) contour matching installation geometry 26A for accommodating a complex compound curvature and features of the installation surface and (2) shutoff surfaces 28 for insert molding of the contour matching conformal gasket 24A over the radome 22. For example, in some embodiments, the contour matching installation geometry 26A can include centrally placed concave cutouts of the contour matching conformal gasket 24A that can be configured to receive a raised ridge of the installation surface.

Figure 2:
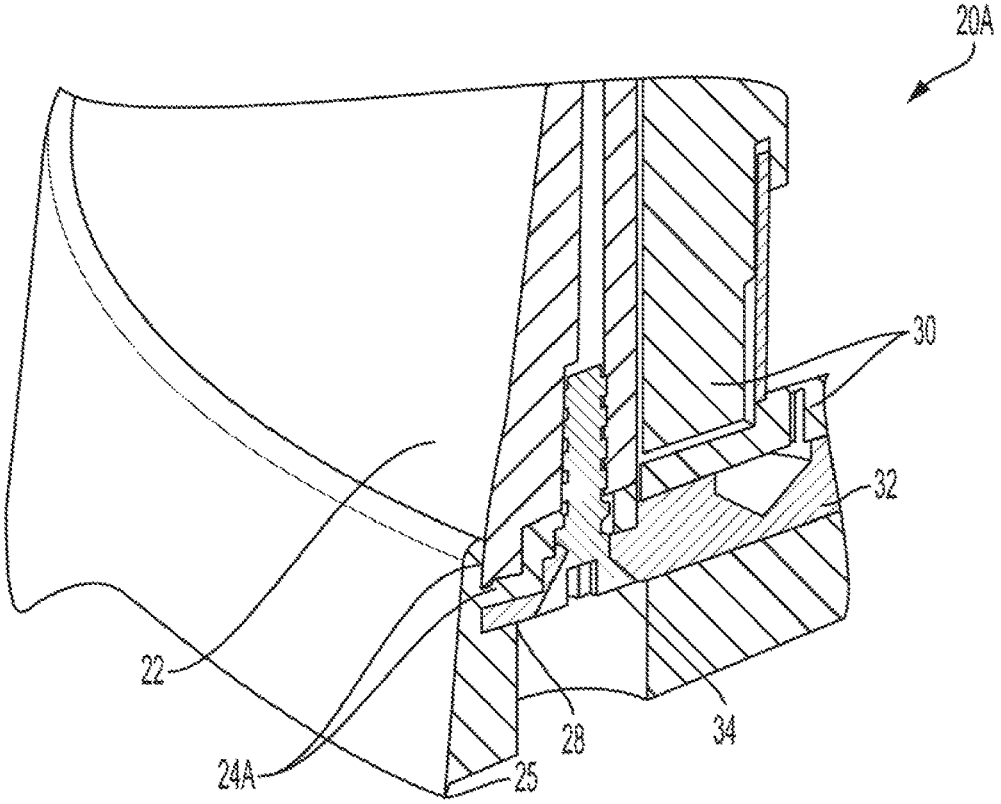
FIG. 2 is a cross-sectional view of an antenna system in accordance with disclosed embodiments.

FIG. 2 is a cross-sectional view of the antenna system 20A in accordance with disclosed embodiments. As seen in FIG. 2, in some embodiments, the radome 22 and the contour matching conformal gasket 24A can protect the RF antenna element 30 from external moisture, dust, or unwanted elements when the antenna system 20A is installed on the installation surface. As also seen in FIG. 2, in some embodiments, the contour matching conformal gasket 24A can be installed on the radome 22 and a base 32 of the RF antenna element 30, and in some embodiments, fasteners 34 can couple the base 32 to the radome 22. For example, in some embodiments, the contour matching conformal gasket 24A can include molded-in and compressible sealing interface features around the fasteners 34 to protect against ingress of the external moisture, dust, or unwanted elements between the radome 22 and the base 32. Still further, in some embodiments, the contour matching conformal gasket 24A can include a wiper edge 25 having a wiper geometry, and in some embodiments, the wiper edge 25 and the shutoff surfaces 28 can be installed on the radome 22 and the base 32 with the fasteners 34 to protect the RF antenna element 30.

Figure 3:
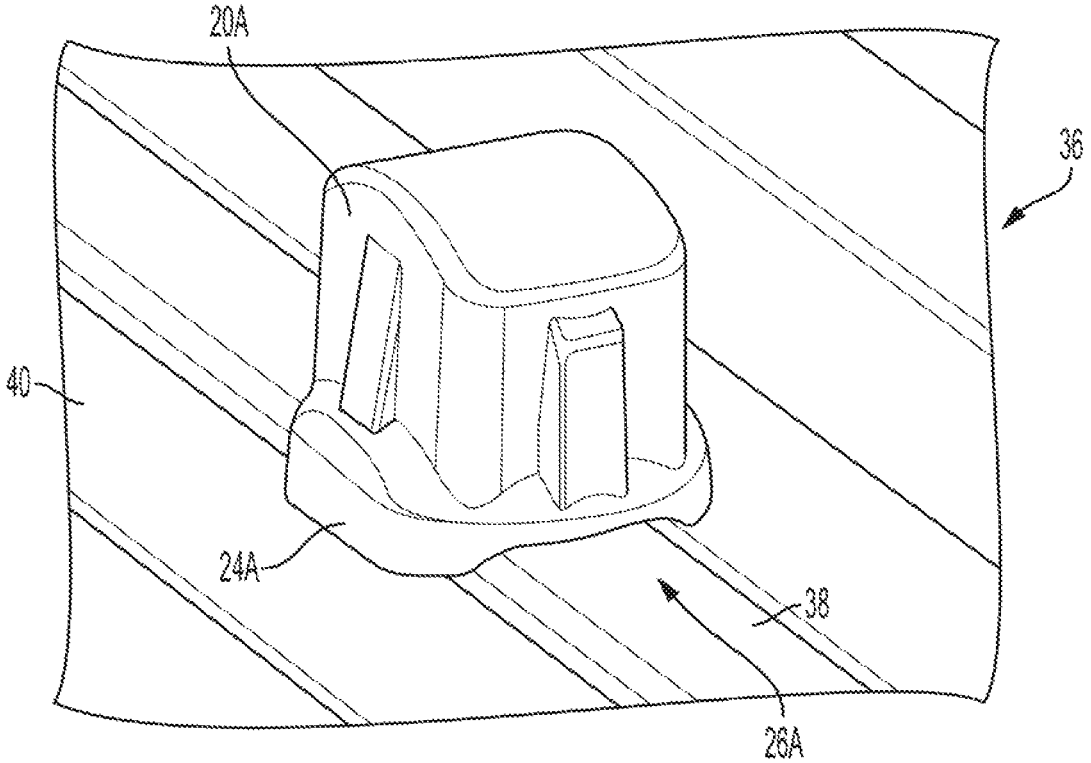
FIG. 3 is a perspective view of an antenna system installed on an installation surface in accordance disclosed embodiments.

FIG. 3 is a perspective view of the antenna system 20A installed on the installation surface 36 in accordance with disclosed embodiments. As seen in FIG. 3, in some embodiments, the installation surface 36 can include raised ridge features 38 and inset valley features 40. Accordingly, in some embodiments, the antenna system 20A can be installed over one of the raised rib features 38 such that the contour matching installation geometry 26A can receive the one of the raised rib features 38 and a remainder of the contour matching conformal gasket 24A can conform to and seal against two of the inset valley features 40 on either side of the one of the raised rib features 38.

Figure 4:
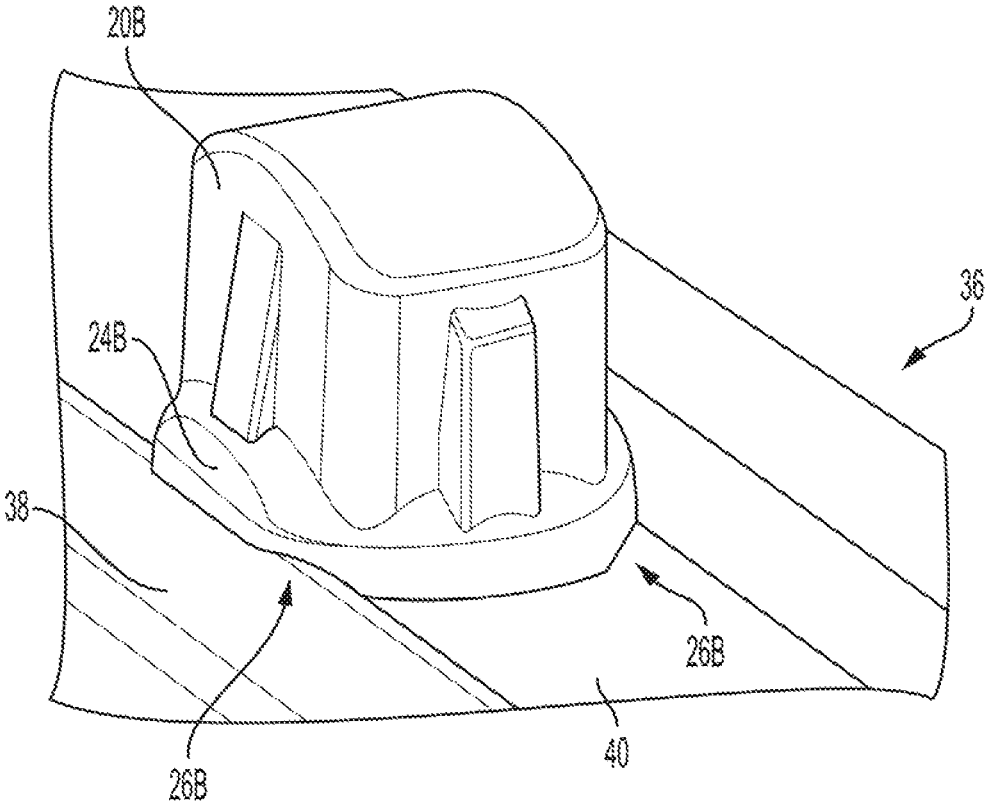
FIG. 4 is a perspective view of an antenna system installed on an installation surface in accordance with disclosed embodiments.
Figure 5:
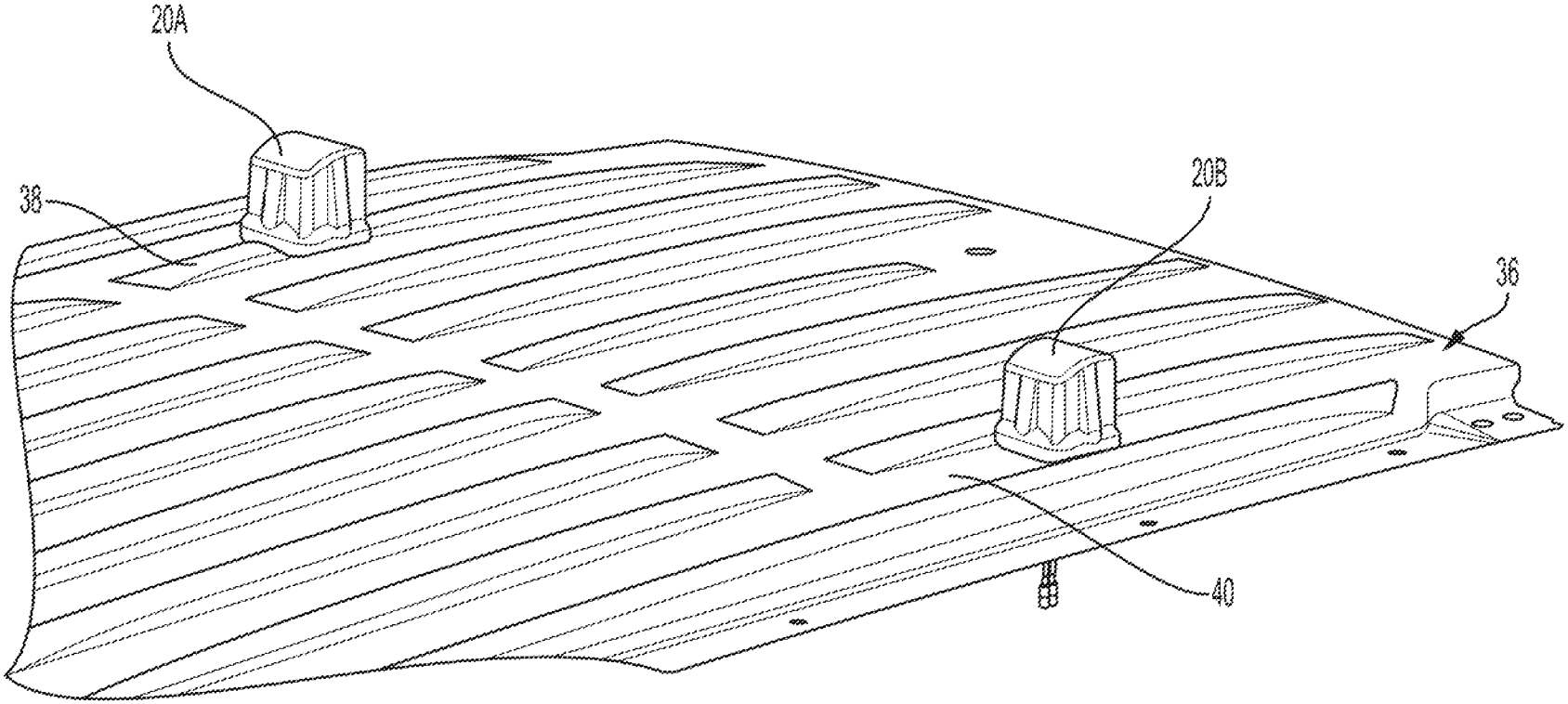
FIG. 5 is a perspective view of a plurality of antenna systems installed on an installation surface in accordance with disclosed embodiments.

However, FIG. 4 is a perspective view of an antenna system 20B installed on the installation surface 36 in accordance with disclosed embodiments. As seen in FIG. 4, the antenna system 20B can be similar to the antenna system 20A except that the antenna system 20B can include a contour marching conformal gasket 24B with contour matching installation geometry 26B. In particular, the contour matching installation geometry 26B can include peripherally placed concave cutouts of the contour matching conformal gasket 24B that can be configured to receive the raised rib features 38 of the installation surface 36 so that, as seen in FIG. 4, the antenna system 20B can be installed on the installation surface 36 in one of the inset valley features 40 between two of the raised rib features 38. As seen in FIG. 5, in some embodiments, both the antenna system 20A and the antenna system 20B can be installed on the installation surface 36 at the same time, bur in different locations.

Figure 6:
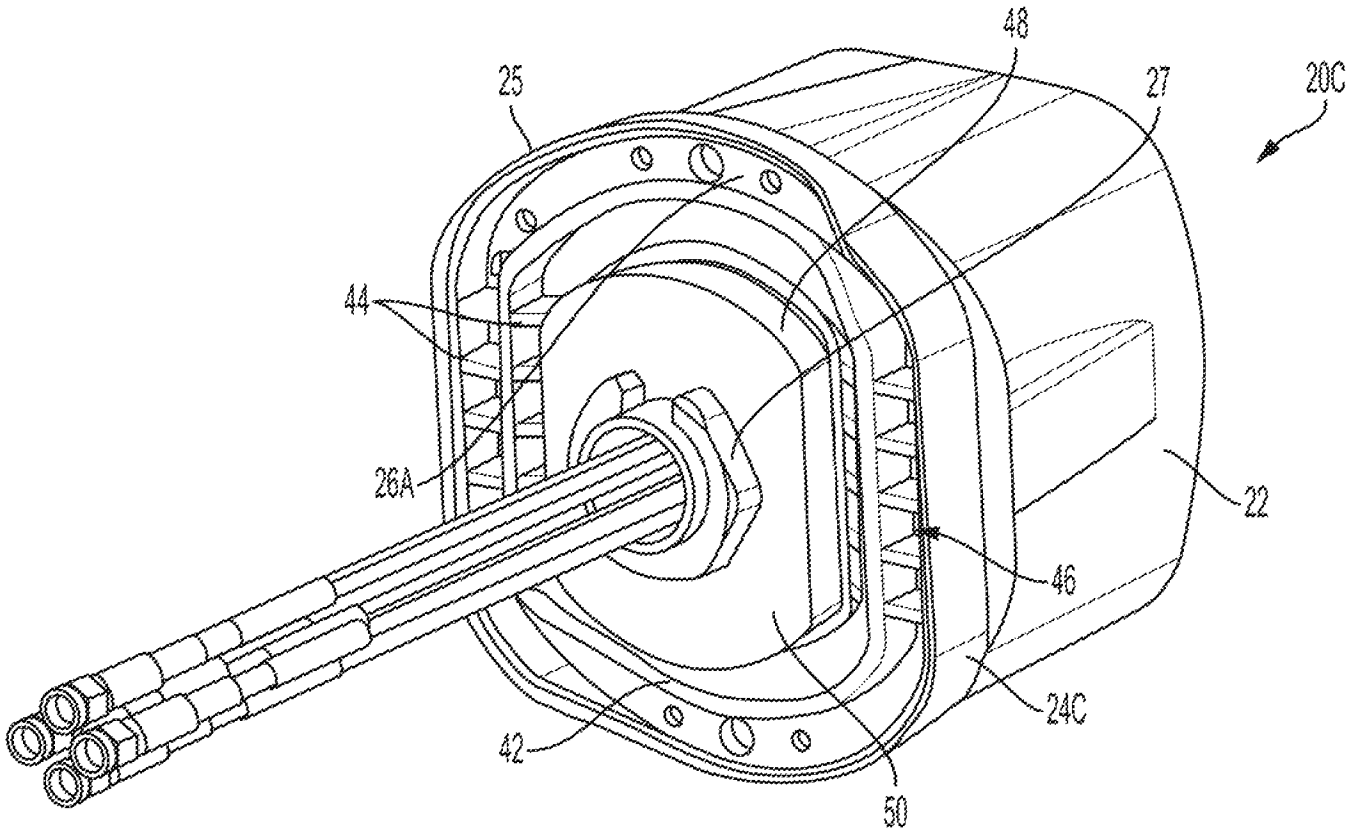
FIG. 6 is a perspective view of an antenna system in accordance with disclosed embodiments.
Figure 7:
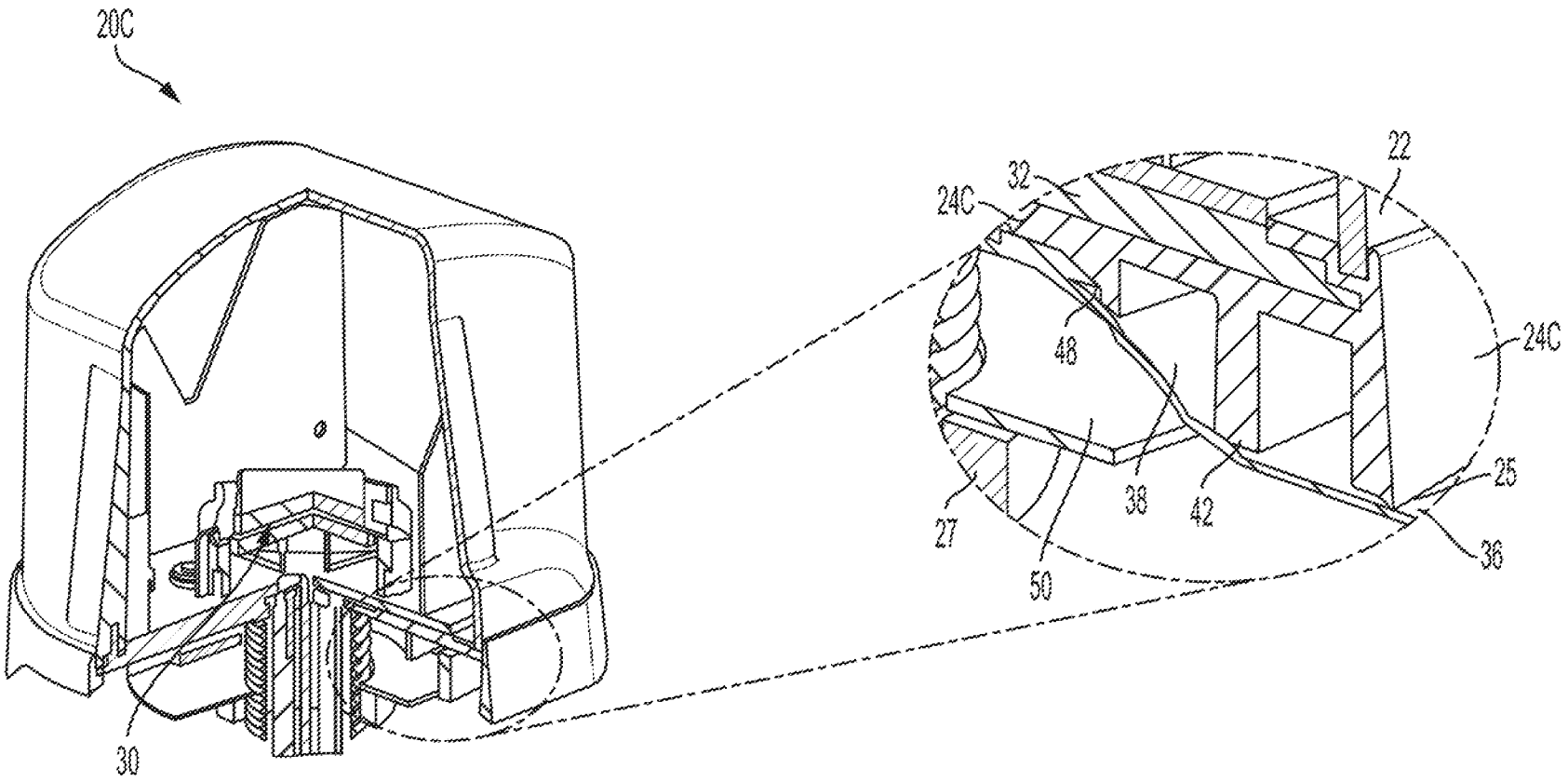
FIG. 7 is a cross sectional view of an antenna system in accordance with disclosed embodiments.
Figure 8:
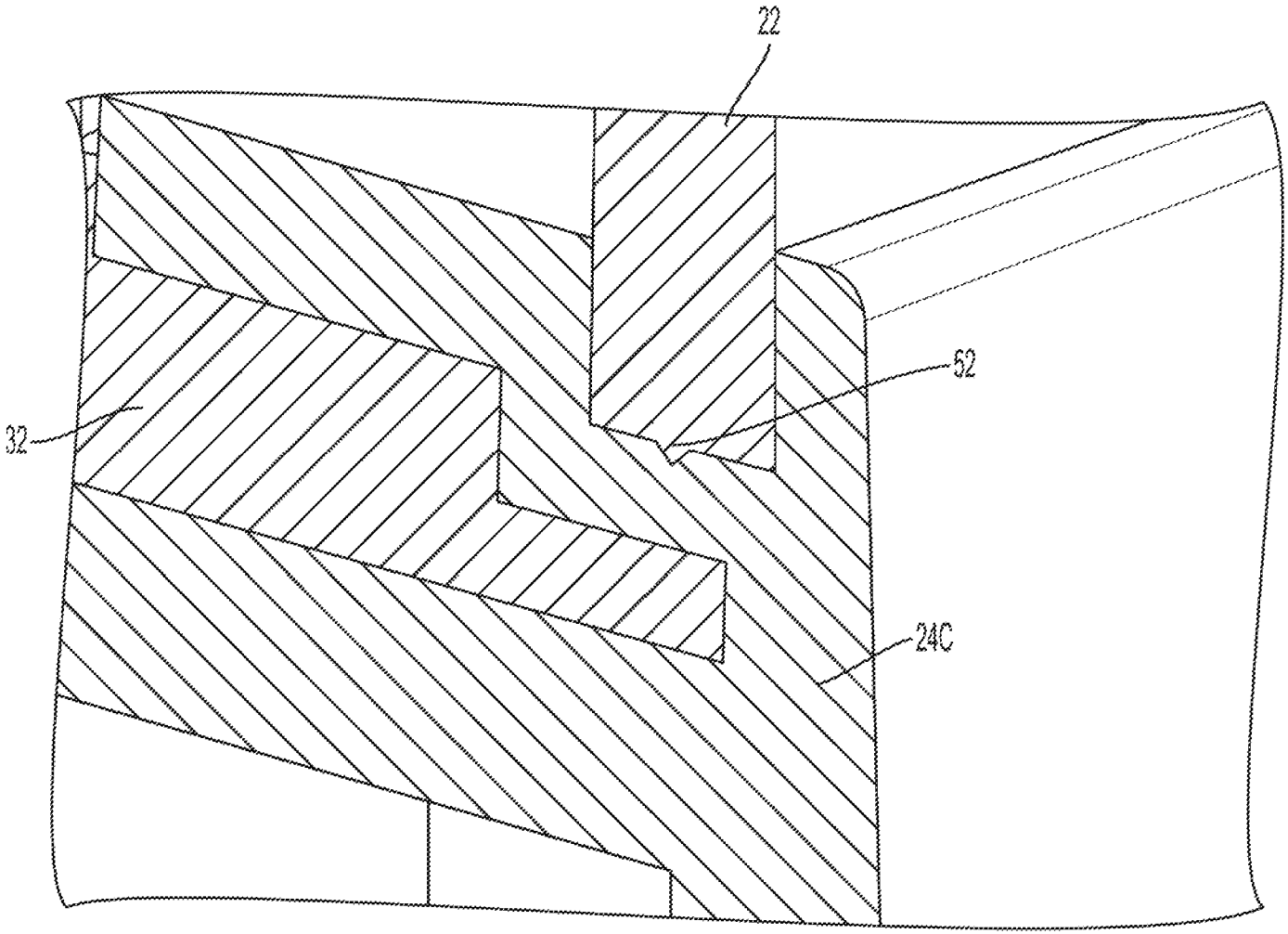
FIG. 8 is a cross-sectional view of an antenna system in accordance with disclosed embodiments.

FIG. 6 is a perspective view of an antenna system 20C in accordance with disclosed embodiments, and FIG. 7 and FIG. 8 are cross-sectional view s of the antenna system 20C in accordance with disclosed embodiments. As seen in FIG. 6, the antenna system 20C can be similar to the antenna system 20A in that the antenna system 20C can include the radome 22 and the fastener 27. However, in some embodiments, the antenna system 20C can also include a contour matching conformal gasket 24C, a high bond tape 48 located in an underside pocket of the contour matching conformal gasket 24C, and a backer plate 50.

As best seen in FIG. 7, in some embodiments, the fastener 27, the high bond tape 48, and the backer plate 50 can be configured to couple the antenna system 20C to the one of the raised rib features 38 on the installation surface 36. For example, in embodiments in which the fastener 27 includes the threaded nut, the fastener 27 can be positioned between the backer plate 50 and the underside of the installation surface 36 and can tighten the backer plate 50 against the underside of the installation surface 36 until the backer plate 50 flexes and conforms to the underside of the installation surface 36. In some embodiments, when the backer plater 50 is tightened to the underside of the installation surface 36, the high bond tape 48 can bond to the one of the raised rib features 38 on the installation surface 36 to assist in sealing the antenna system 20C to the installation surface 36 and to provide rotational resistance.

Similar to the contour matching conformal gasket 24A, in some embodiments, the contour matching conformal gasket 24C can include the wiper edge 25 and the contour matching installation geometry 26A. As such and as, seen in FIG. 7, when the antenna system 20C is coupled to the installation surface 36, the wiper geometry of the wiper edge 25 can sweep along a prevailing perimeter edge geometry of the contour matching conformal gasket 24C to account for tolerance range variations of the installation surface 36. Additionally or alternatively, in some embodiments, the wiper edge 25 can compress during installation to produce a perimeter squeezing effect of the contour matching conformal gasket 24C with respect to outer walls of the radome 22 to enhance a primary seal between the radome 22 and the contour matching conformal gasket 24C.

However, as best seen in FIG. 6, in Some embodiments, the contour matching conformal gasket 24C can also include a secondary seal 42 inside of a footprint of the wiper edge 25, a cored out hollow section 46 between the wiper edge 25 and the secondary seal 42, and/or a plurality of stiffening ribs 44 coupled between the secondary seal 42 and the wiper edge 25. For example, in some embodiments, the plurality of stiffening ribs 46 can be positioned radially to provide controlled deflection of an outer wall of the contour matching conformal gasket 24C, thereby resulting in uniform compression of the wiper edge 25 onto the installation surface 36. Additionally or alternatively, in some embodiments, the cored oat hollow section 46 can allow the secondary seal 42 to adapt to contours of and seal onto of the installation surface 36.

Finally, as best seen in FIG. 8, in some embodiments, the radome 22 can include a compression concentration feature 52 along a sealing interface of an outer wall of the radome 22, and in some embodiments, the compression concentration feature 52 can generate an enhanced compression area around a perimeter of the radome 22, bite down into the contour matching conformal gasket 24C to limit lateral distortion of the contour matching conformal gasket 24C, and/or increase an effective contact surface area between the contour matching conformal gasket 24C and the radome 22. Advantageously, such an increase in the effective contact surface area can increase a length of an ingress path for the external moisture, dust, or unwanted elements into the radome 22.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. An antenna system comprising:

an RF antenna element;

a radome housing the RF antenna element; and a contour matching conformal gasket sealed to the radome, the contour matching conformal gasket further comprising:

a wiper edge having a wiper geometry configured to sweep along a prevailing perimeter edge geometry of the contour matching conformal gasket to account for tolerance range variations of an installation surface;

a secondary seal inside of a footprint of the wiper edge, and a plurality of stiffening ribs coupled between the secondary seal and the wiper edge, wherein, when the contour matching conformal gasket is installed on the installation surface having a complex compound curvature and features, the contour matching conformal gasket is configured to conform to the complex compound curvature and features to seal the contour matching conformal gasket to the installation surface and protect the RF antenna element from external moisture, dust, or unwanted elements.

2. The antenna system of claim 1 further comprising:

a base, wherein the RF antenna element is mounted to the base, and wherein the contour matching conformal gasket is coupled between the radome and the base.

3. The antenna system of claim 2 wherein the contour matching conformal gasket includes sealing interface features that match sealing geometries of the base and the radome.

4. The antenna system of claim 2 wherein the contour matching conformal gasket is over molded onto the base.

5. The antenna system of claim 1 wherein the contour matching conformal gasket is coupled to the radome.

6. The antenna system of claim 1 wherein the wiper edge is configured to compress during installation to produce a perimeter squeezing effect of the contour matching conformal gasket with respect to outer walls of the radome to enhance a primary seal between the radome and the contour matching conformal gasket.

7. The antenna system of claim 6 wherein the contour matching conformal gasket includes a cored out hollow section between the wiper edge and the secondary seal.

8. The antenna system of claim 1 further comprising:

a backer plate that is configured to conform to an underside of the installation surface when tightened thereto; and a high bond tape that is located in an underside pocket of the contour matching conformal gasket and configured to bond to a topside of the installation surface when the backer plate is tightened to the underside of the installation surface.

9. The antenna system of claim 1 wherein the radome includes a compression concentration feature along a sealing interface of an outer wall of the radome, wherein the compression concentration feature is configured to generate an enhanced compression area around a perimeter of the radome, bite down into the contour matching conformal gasket to limit lateral distortion of the contour matching conformal gasket, and increase an effective contact surface area between the contour matching conformal gasket and the radome, and wherein an increase in the effective contact surface area increases a length of an ingress path for the external moisture, dust, or unwanted elements into the radome.

10. A method comprising:

positioning an antenna system onto a topside of an installation surface so that a contour matching conformal gasket of the antenna system conforms to a complex compound curvature and features of the topside of the installation surface; and tightening a fastener to an underside of the installation surface to seal the contour matching conformal gasket to the topside of the installation surface and protect internal elements of the antenna system from external moisture, dust, or unwanted elements;

compressing a wiper edge of the contour matching conformal gasket against the topside of the installation surface to produce a perimeter squeezing effect of the contour matching conformal gasket with respect to outer walls of a radome of the antenna system to enhance a primary seal between the radome and the contour matching conformal gasket; and compressing a secondary seal of the contour matching conformal gasket onto the topside of the installation surface, wherein the contour matching conformal gasket includes a plurality of stiffening ribs coupled between the secondary seal and the wiper edge.

11. The method of claim 10 further comprising:

tightening a backer plate between the fastener and the underside of the installation surface, wherein the backer plate conforms to the underside of the installation surface when tightened to the underside of the installation surface; and bonding a high bond tape located in an underside pocket of the contour matching conformal gasket to the topside of the installation surface when the backer plate is tightened to the underside of the installation surface.

12. The method of claim 10 wherein the wiper edge includes a wiper geometry configured to sweep along a prevailing perimeter edge geometry of the contour matching conformal gasket to account for tolerance range variations of the topside of the installation surface.

13. The method of claim 12 wherein the secondary seal is located inside of a footprint of the wiper edge.

14. The method of claim 13 wherein the contour matching conformal gasket includes a cored out hollow section between the wiper edge and the secondary seal.

15. The method of claim 10 further comprising:

compressing a compression concentration feature of a radome of the antenna system onto the contour matching conformal gasket to generate an enhanced compression area around a perimeter of the radome, bite down into the contour matching conformal gasket to limit lateral distortion of the contour matching conformal gasket, and increase an effective contact surface area between the contour matching conformal gasket and the radome, wherein an increase in the effective contact surface area increases a length of an ingress path for the external moisture, dust, or unwanted elements into the radome.

16. A method comprising:

mounting an RF antenna element on a base;

housing the RF antenna element inside of a radome; and molding a contour matching conformal gasket over a portion of the radome and between the radome and the base to seal the contour matching conformal gasket to the radome, the contour matching conformal gasket further comprising:

a wiper edge having a wiper geometry configured to sweep along a prevailing perimeter edge geometry of the contour matching conformal gasket to account for tolerance range variations of an installation surface;

a secondary seal inside of a footprint of the wiper edge, and a plurality of stiffening ribs coupled between the secondary seal and the wiper edge, wherein, when the contour matching conformal gasket is installed on the installation surface having a complex compound curvature and features, the contour matching conformal gasket is configured to conform to the complex compound curvature and features to seal the contour matching conformal gasket to the installation surface and protect the RF antenna element from external moisture, dust, or unwanted elements.

17. The method of claim 16 wherein molding the contour matching conformal gasket includes one of insert molding, multi-shot injection molding, reaction injection molding (RIM), cast over molding, or lamination.

* * * * *